US009765479B2

(12) United States Patent
Sjöström et al.

(10) Patent No.: US 9,765,479 B2
(45) Date of Patent: Sep. 19, 2017

(54) BLADE SEGMENT OF DISC REFINER

(71) Applicants: Håkan Sjöström, Tampere (FI); Matti Kaarineva, Lempäälä (FI); Tomi Iisakkila, Valkeakoski (FI)

(72) Inventors: Håkan Sjöström, Tampere (FI); Matti Kaarineva, Lempäälä (FI); Tomi Iisakkila, Valkeakoski (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 224 days.

(21) Appl. No.: 14/741,282

(22) Filed: Jun. 16, 2015

(65) Prior Publication Data

US 2016/0145798 A1 May 26, 2016

(30) Foreign Application Priority Data

May 26, 2014 (FI) ..... 20144124

(51) Int. Cl.
*B02C 7/12* (2006.01)
*D21D 1/30* (2006.01)
*B02C 7/02* (2006.01)

(52) U.S. Cl.
CPC ..... *D21D 1/306* (2013.01); *B02C 7/02* (2013.01); *B02C 7/12* (2013.01)

(58) Field of Classification Search
CPC ..... D21D 1/306; B02C 7/02; B02C 7/12
USPC ..... 241/261.2, 261.3, 296, 297, 298
See application file for complete search history.

(56) References Cited

U.S. PATENT DOCUMENTS

| | | | | |
|---|---|---|---|---|
| 2,986,434 | A | 5/1961 | Baxter, Jr. | |
| 2007/0084952 | A1* | 4/2007 | Sjostrom | B02C 7/12 241/261.2 |

FOREIGN PATENT DOCUMENTS

| | | | |
|---|---|---|---|
| DE | 102010002459 | A1 | 9/2011 |
| EP | 2559807 | A1 | 2/2013 |
| WO | 9525199 | A1 | 9/1995 |
| WO | 2012101330 | A1 | 8/2012 |

OTHER PUBLICATIONS

European Search Report for EP15166589 dated Sep. 29, 2015.
Search Report for FI20144124 dated Jun. 23, 2014.

* cited by examiner

*Primary Examiner* — Mark Rosenbaum
(74) *Attorney, Agent, or Firm* — Stiennon & Stiennon

(57) ABSTRACT

A blade segment of a disc refiner for refining fibrous material has an inner circumference and an outer circumference as well as a first side edge and a second side edge which connect the inner circumference and the outer circumference. The side edges are curved, with one convex and the other concave. The segment has a refining surface with blade bars and grooves which define a pumping direction. The side edges of the blade segment curve in the vicinity of the inner circumference in the pumping direction, and in the vicinity of the outer circumference in a non-pumping direction.

14 Claims, 2 Drawing Sheets

BLADE SEGMENT OF DISC REFINER

CROSS REFERENCES TO RELATED APPLICATIONS

This application claims priority on Finnish application FI 20144124, filed May 26, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a blade segment of a disc refiner intended for refining lignocellulose material used in the production of fibrous material such as paper and board, with the blade segment comprising an inner circumference and an outer circumference as well as a first side edge and a second side edge which combine the inner circumference and the outer circumference.

A disc refiner consists of two or more opposite refining elements, at least one of which refining elements is rotatable. The rotating refining element can be referred to as a rotor, and the non-rotating, or stationary, refining element can be referred to as a stator. Between the refining elements is a refining gap, where the material to be refined is ground against the refining surfaces. The refining surface of the refining elements comprises blade bars and blade grooves. The refining surface is constituted by attaching one or more blade elements to the frame structure of the refining element, with the blade element having a refining surface which comprises blade bars and blade grooves. In stationary refining elements, said blade element can also be attached directly to the frame structure of the refiner. The refining surface of the refining element can consist of one uniform blade element, in which case a single individual annular planar blade element can constitute an entire refining surface of a refining element. Conventionally, the refining surface of the refining element of a disc refiner is, however, constituted of several planar blade segments placed side by side, in which case each blade segment on its own constitutes only some portion of the complete annular refining surface of the refining element, and the blade segments placed side by side together constitute the complete annular refining surface of the refining element.

A typical blade segment comprises an inner circumference of the blade segment directed in the direction of the inner circumference of the refining element and an outer circumference of the blade segment directed in the direction of the outer circumference of the refining element, and a first side edge of the blade segment and a second side edge of the blade segment connecting the inner circumference and the outer circumference of the blade segment, where the first side edge and the second side edge are straight, i.e. in the radial direction of the blade segment so that the blade segment resembles the shape of a sector of a ring. It is typical for said blade segments that the side edges of the blade segments constitute a point of discontinuity at the interface or at the point of contact of adjacent blade segments, which can result for example in disturbances both in the actual refining and in the flow of the material that is to be refined and that has been refined at the interfaces of adjacent blade segments and in their vicinity. Moreover, in order to ensure the structural strength of the blade bars, there is a need to make reinforcements when moving from one blade segment to another. There are also prior art blade segments where the side edges are not straight, i.e. not in the radial direction of the blade segment, but instead in the vicinity of the inner circumference the side edge is in the radial direction and then turns at one point away from the radial direction against the intended direction of rotation of the blade segment. Such a construction requires precise tolerances at the interfaces of the blade segments so that unrefined pulp would not escape through the refiner.

SUMMARY OF THE INVENTION

The object of the invention is to provide a novel blade segment of a disc refiner.

The blade segment of a disc refiner according to the invention is characterized in that the first side edge and the second side edge of the blade segment are curved so that one side edge is concave and the other side edge is convex.

According to an embodiment, the first side edge and the second side edge of the blade segment are curved side edges which comprise a single radius of curvature.

According to an embodiment, the blade segment comprises a refining surface, which comprises first refining surface portions that refine the material to be refined and second refining surface portions that run between the first refining surface portions and that carry the material to be refined, and the center line of the first refining surface portions and of the second refining surface portions is curved.

According to an embodiment, the magnitude of the radius of curvature and the direction of curvature of the center line of the first side edge and second side edge of the blade segment and of the second refining surface portion are essentially the same.

According to an embodiment, the first refining surface portion comprises a first blade bar running from the direction of the inner circumference of the blade segment to the direction of the outer circumference and the second refining surface portion is a first blade groove running from the direction of the inner circumference of the blade segment to the direction of the outer circumference and the upper surface of the first blade bar comprises second blade bars and between them second blade grooves.

According to an embodiment, the first refining surface portion comprises blade bars and between them blade grooves, and the second refining surface portion is a blade groove running from the direction of the inner circumference of the blade segment to the direction of the outer circumference.

According to an embodiment, at least one side edge of the blade segment comprises an area free from blade bars to constitute at least some portion of the second refining surface portion that is constituted between two adjacent blade segments.

According to an embodiment, the volume of at least one blade groove included in the first refining surface portion is adapted to change in the run direction of the blade groove.

According to an embodiment, the width and/or depth of the blade groove included in the first refining surface portion is adapted to change in the run direction of the blade groove.

According to an embodiment, the width and/or depth of the first blade groove constituting the second refining surface portion is adapted to change in the run direction of the blade groove.

According to an embodiment, the first side edge and second side edge of the blade segment curve in the vicinity of the inner circumference to the pulp-carrying direction, i.e. to the pumping direction, and in the vicinity of the outer circumference to the pulp-holding direction, i.e. to the non-pumping direction.

According to an embodiment, in the area on the side of the outer circumference of the blade segment, the portion of the non-pumping curve is 0 to 50%, preferably approximately 20 to 40% and most preferably over approximately 30% of the radius of the blade segment.

According to an embodiment, the blade segment is a blade segment of a rotatable refining element.

BRIEF DESCRIPTION OF THE DRAWINGS

The invention is now described in greater detail in connection with some preferred embodiments by making reference to the accompanying drawings.

For the sake of clarity, the figures show some embodiments of the invention in a simplified manner. In the figures, like reference numerals identify like elements.

DESCRIPTION OF THE PREFERRED EMBODIMENTS

Figure 1:
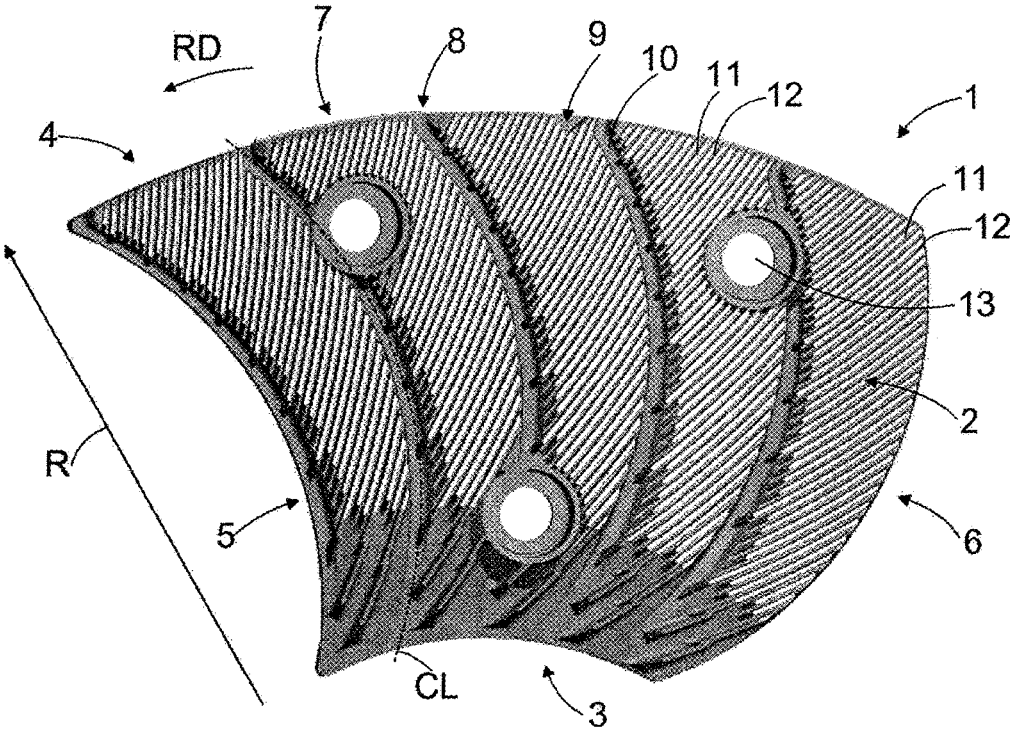
FIG. 1 schematically shows a blade segment seen in the direction of its refining surface.

FIG. 1 schematically shows a blade segment 1 of a disc refiner, i.e. a planar blade segment 1 seen in the direction of the refining surface 2 of the blade segment 1. The blade segment 1 shown in FIG. 1 is thus a planar blade segment that can be adapted to be a part of the stationary refining element of the disc refiner, i.e. a part of the stator, whereby the refining surface 2 of the blade segment 1 constitutes a portion of the refining surface of the stationary refining element, or it can be adapted to be a part of the rotating refining element of the disc refiner, i.e. a part of the rotor, whereby the refining surface 2 of the blade segment 1 constitutes a portion of the refining surface of the rotatable refining element. The blade segment 1 can have securing openings 13, through which securing bolts can be inserted in order to fasten the blade segment 1 to the refining element. The blade segment can also be secured to the refining element so that the securing points do not extend through the blade segment, but there is bolt securing only at the back part of the blade segment, whereby the refining surface of the blade segment, i.e. the blade surface, remains intact.

The blade segment 1 comprises an inner circumference 3 or inner edge 3 or feed edge 3 directed to the direction of the inner circumference of the refining element of the refiner, and from the direction of the inner circumference 3 or inner edge 3 or feed edge 3 the material to be refined is fed into the refining gap, i.e. blade gap, located between the opposite refining elements of the refiner. The blade segment 1 further comprises an outer circumference 4 or outer edge 4 or outlet edge 4 directed to the direction of the outer circumference of the refining element of the refiner, and the material to be refined travels in the blade gap of the refiner during refining to the direction of the outer circumference 4 or outer edge 4 or outlet edge 4 and the material that has been refined exits the blade gap of the refiner through it. The inner circumference 3 and outer circumference 4 of the blade segment 1 constitute a portion of the inner circumference and outer circumference of a complete refining surface of a refining element. The blade segment further comprises a first side edge 5 and a second side edge 6 connecting the inner circumference 3 and outer circumference 4 of the blade segment 1.

The refining surface 2 of the blade segment 1 comprises first refining surface portions 7 and between them second refining surface portions 8, with the first refining surface portions 7 constituting refining surface portions that refine the material to be refined and with the second refining surface portions constituting refining surface portions that run between the first refining surface portions and that carry the material to be refined.

In the embodiment of FIG. 1, the first refining surface portion 7 of the blade segment 1 comprises a first blade bar 9 and second blade bars 11 constituted at its upper surface and between them second blade grooves 12, with the second refining surface portions 8 being constituted by the first blade grooves 10 between the first blade bars 9, and the first blade grooves 10 constitute the feed grooves 10 of the blade segment 1, which feed grooves 10 carry the material to be refined from the direction of the inner circumference 3 of the blade segment 1 to the direction of the outer circumference 4. The width of the second blade bars 11 can be for example approximately 1.2 to 1.4 millimeters and the width of the second blade grooves 12 can be for example approximately 1.8 to 2.0 millimeters. The depth of the second blade grooves 12 can be for example approximately 5.0 to 7.0 millimeters. The width of the first blade grooves 10 on the inner circumference 3 of the blade segment 1 can be for example approximately 15 mm and can become narrower towards the outer circumference 4 for example so that the width of the first blade grooves 10 on the outer circumference 4 of the blade segment 1 is for example approximately 5 mm. The depth of the first blade grooves 10, i.e. the distance from the upper surface of the second blade bars 11 to the bottom of the first blade bars 10 is greater than the depth of the second blade grooves 12. The depth of the first blade grooves 10 can become smaller, i.e. the first blade grooves 10 can become shallower towards the outer circumference 4 of the blade segment 1, but in this case, too, the depth of the first blade grooves 10 on the outer circumference 4 of the blade segment 1 is greater than the depth of the second blade grooves 12. The second blade bars 11 and between them the second blade grooves 12 constitute dense blading, i.e. so-called microblading, on the refining surface 2 of the blade segment 1, whereby the shearing length of the refining surface 2 of the blade segment 1 becomes considerably large. Said second blade bars 11 and second blade grooves 12 can be straight or curved in their respective run direction. The width and height of the second blade bars 11 and correspondingly the width and depth of the second blade grooves 12 can be constant or they can vary in the run direction of said blade bars 11 and blade grooves 12.

In the embodiment of FIG. 1, the first blade bars 9 and the first blade grooves 10 are curved, i.e. they run from the direction of the inner circumference 3 of the blade segment 1 to the direction of the outer circumference 4 of the blade segment 1 in a curved pattern, or in other words the center lines of the first blade bars 9 and the first blade grooves 10 are curved, i.e. they run from the direction of the inner circumference 3 of the blade segment 1 to the direction of the outer circumference 4 of the blade segment 1 in a curved pattern. The center line referred to in FIG. 1 is only illustrated at one first blade groove 10 on the side of the first side edge 5 and marked with reference marking CL.

Figure 4:
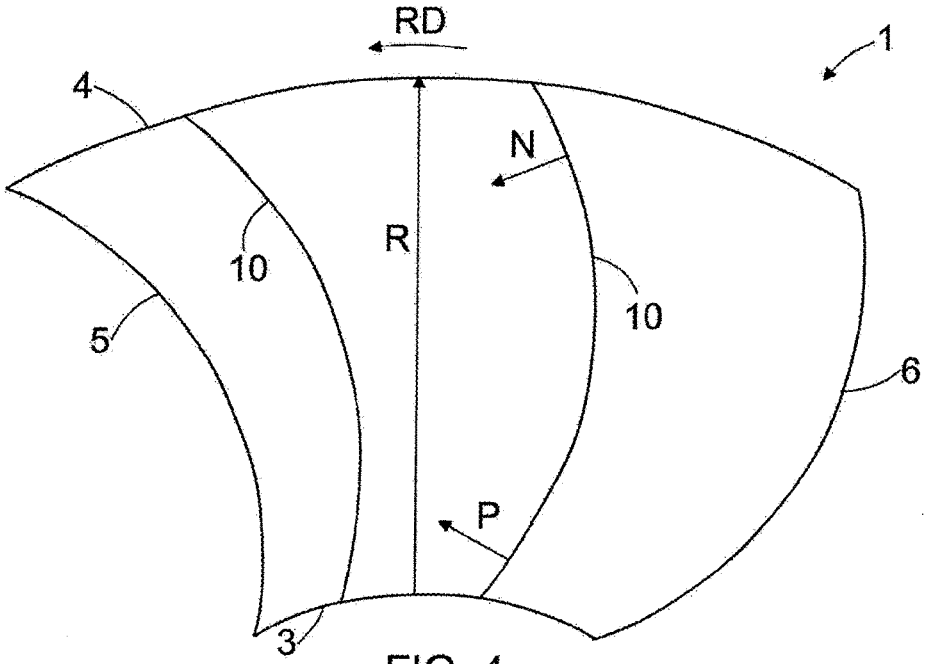
FIG. 4 schematically shows a blade segment shown in FIGS. 1, 2 and 3 in outline representation.

The shape of the first blade groove 10 is curved so that in the vicinity of the inner circumference 3 of the blade segment 1 it is pumping, i.e. it enhances the travel of the pulp to be refined from the direction of the inner circumference 3 of the blade segment 1 towards the outer circumference 4, when the blade segment 1 constitutes a portion of the refining surface of the rotatable refining element and when the direction of rotation corresponds to the direction indicated by the arrow denoted with reference marking RD in FIG. 1. When moving towards the outer circumference 4 of the blade segment 1, the blade groove 10 curves back so that in the vicinity of the outer circumference 4 of the blade segment 1 the blade groove 10 is non-pumping, i.e. it slows down the travel of the pulp to be refined towards the outer circumference 4 of the blade segment 1. The pumping and non-pumping effect caused in the material to be refined by the rotation of the rotating refining element and by the direction of the first blade bars 10 on the refining surface is further illustrated in FIG. 4, which schematically shows the outlines of the blade segment 1 and the first blade grooves 10 running in the blade segment 1. On the side of the inner circumference 3 of the blade segment 1, the rotation of the rotating refining element and the direction of the first blade grooves 10 induce that the material to be refined is subject to a force effect the resultant of which is described by the arrow denoted with the reference marking P and which is directed towards the outer circumference 4 of the blade segment 1. This can be seen for example by comparing the direction of the arrow P to the direction of the radius R of the blade segment 1. On the side of the inner circumference 3 of the blade segment 1, the material to be refined is thus subject to a force effect which promotes the travel of the material to be refined, i.e. it pumps the material to be refined towards the outer circumference 4 of the blade segment 1. On the side of the outer circumference 4 of the blade segment 1, as a result of the direction of the first blade grooves 10 the material to be refined is subject to a force effect the resultant of which is described by the arrow denoted with the reference marking N and which is directed towards the inner circumference 3 of the blade segment 1. This can again be seen for example by comparing the direction of the arrow N to the direction of the radius R of the blade segment 1. On the side of the outer circumference 4 of the blade segment 1, the material to be refined is thus subject to a force effect which slows down or holds the travel of the material to be refined towards the outer circumference 4 of the blade segment 1, in other words it has a non-pumping effect on the material to be refined.

In other words, when the blade segment 1 according to FIG. 1 is intended to constitute a portion of the refining surface of the rotatable refining element and the direction of rotation of said refining element corresponds to the direction of the arrow denoted with the reference marking RD in FIG. 1, the direction of the feed groove 10 on the side of the inner circumference 3 of the blade segment 1 intensifies the travel of the material to be refined towards the direction of the outer circumference 4 of the blade segment 1, and correspondingly on the side of the outer circumference 4 of the blade segment 1 the direction of the feed groove 10 slows down the travel of the material to be refined towards the direction of the outer circumference 4 of the blade segment 1.

Figure 2:
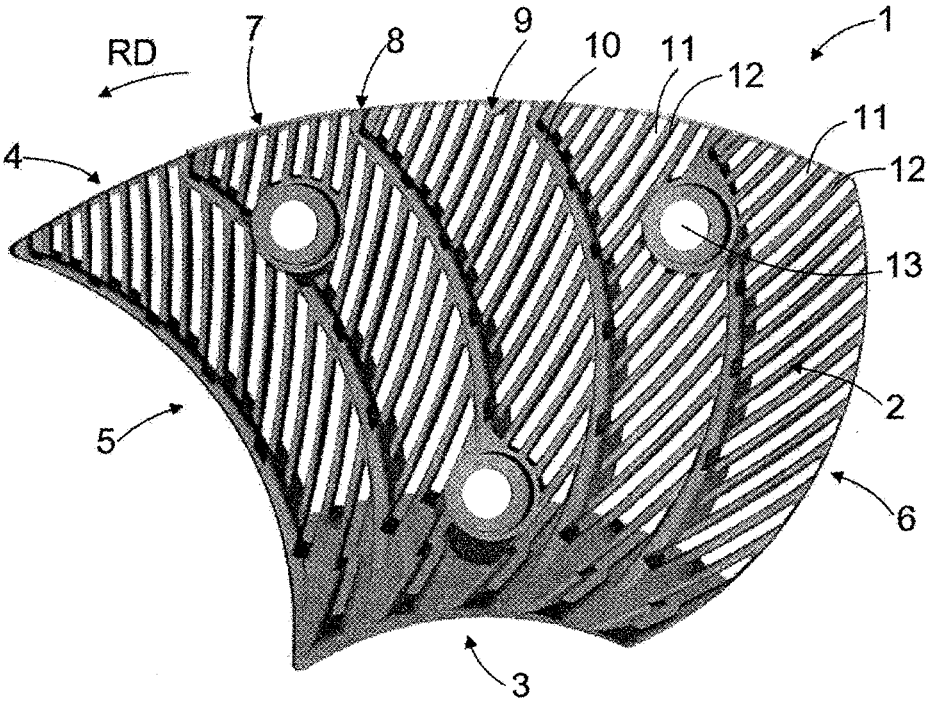
FIG. 2 schematically shows a second blade segment seen in the direction of its refining surface.
Figure 3:
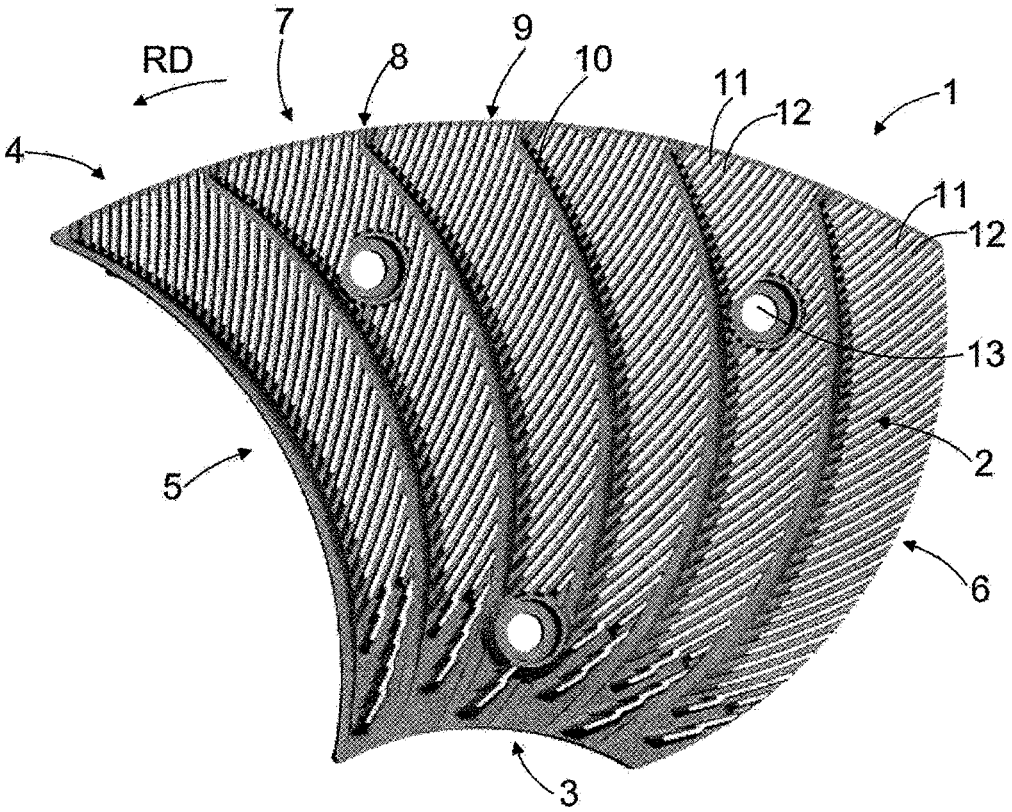
FIG. 3 schematically shows a third blade segment seen in the direction of its refining surface.

FIG. 1 shows and also FIGS. 2 and 3 show the portion of the refining surface of the rotatable refining element, i.e. of the refining surface of the rotor, constituting the blade segment 1, but a similar piece can also be used in the stationary refining element, i.e. in the stator.

When the direction of rotation of the rotatable refining element of the refiner corresponds to the direction of the arrow denoted with the reference marking RD in FIG. 1, the first side edge 5 of the blade segment 1 thus corresponds to the side edge of the blade segment adapted to the direction of rotation of the rotatable refining element and the second side edge 6 of the blade segment 1 thus corresponds to the side edge of the blade segment adapted to the direction opposite to the direction of rotation of the rotatable refining element. When seen in the direction of rotation RD, the first side edge 5 of the blade segment 1 thus constitutes the front edge of the blade segment 1 and the second side edge 6 of the blade segment 1 constitutes the back edge of the blade segment 1.

In the blade segment 1 according to FIG. 1, the first side edge 5 and second side edge 6 of the blade segment 1 are curved, in other words the first or front side edge 5 and second or back side edge 6 of the blade segment 1 run in a curved pattern from the inner circumference 3 of the blade segment 1 to the outer circumference 4 so that the first side edge 5 of the blade segment 1 has the shape of a concave curve and the second side edge 6 has the shape of a convex curve, in other words the center point of the radius of curvature of the curves constituted by the side edges 5 and 6 is residing in the direction of rotation RD of the rotatable refining element, ie. when rotating counter clockwise as in FIGS. 1-4 the center points of the radii of the side edge curves reside on the left side of the corresponding side edges, and, respectively, the bottom points of the side edge curves are thus residing opposite to the rotating direction. Since the center point of the radius of curvature of the curves constituted by both side edges 5 and 6 is located in the same direction with respect to the direction of rotation RD of the rotatable refining element, it can be said that the direction of curvature of the curved side edges 5, 6 is the same. Moreover, in order to simplify the structure of the blade segment 1, the magnitude or value of the radii of curvature of the side edges 5, 6 is essentially the same. The first side edge 5 and second side edge 6 of the blade segment 1 are curved so that the first side edge 5 and second side edge 6 curve in the vicinity of the inner circumference 3 to the pulp-carrying direction, i.e. to the pumping direction, and in the vicinity of the outer circumference 4 to the pulp-holding direction, i.e. to the non-pumping direction.

Both the first curved side edge 5 and second curved side edge 6 of the blade segment 1 are composed of only one radius of curvature. The magnitude of the radius of curvature may vary on the basis of the size category of the blade segment 1, i.e. on the basis of the distance between the inner circumference 3 and outer circumference 4 of the blade segment 1, i.e. on the basis of the radius R of the blade segment 1. FIG. 1 schematically shows the radius R of the blade segment 1 beside the first side edge 5 of the blade segment 1. The essential matter is that when the blade segment 1 constitutes a portion of the refining surface of the rotatable refining element, the side edges 5 and 6 of the blade segment 1 curve in the vicinity of the inner circumference 3 to the pulp-carrying direction, i.e. to the pumping direction, and in the vicinity of the outer circumference 4 to the non-pumping direction, i.e. to the pulp-holding direction. In the area on the side of the outer circumference 4, the portion of the non-pumping curve is 0 to 50%, preferably approximately 20 to 40% and most preferably over approximately 30% of the radius R of the blade segment 1. When the first side edge 5 and second side edge 6 of the blade segment 1 are curved in this manner, the blade segments 1 can be aligned easily with respect to each other upon the installation of the blade segments 1 to the refining elements of the refiner. Another advantage of the structure is that the blade segments can be manufactured with larger tolerances without the possibility that unrefined pulp escapes from between the blade segments.

The curved side edges 5 and 6 of the blade segment 1 are especially advantageous when the second refining surface portions 8, i.e. the first blade grooves 10, i.e. the feed grooves 10 included in the blade segment 1 are made to be curved, as presented in FIG. 1 and in the related description above, so that the radius and direction of curvature of the side edges 5 and 6 of the blade segment 1 and the radius and direction of curvature of the first blade grooves 10 of the blade segment 1 are the same. In this case, the first refining surface portions 7, i.e. the first blade bars 9, and the second refining surface portions 8, i.e. the first blade grooves 10 running from the direction of the inner circumference 3 of the blade segment 1 to the direction of the outer circumference 4 in a curved manner can be arranged easily in the blade segment 1 without a need for the first blade bar 9 or the first blade groove 10 to continue from the direction of the inner circumference 3 to the direction of the outer circumference 4 over the interface of adjacent blade segments 1 from one blade segment to another in order to accomplish a desired refining surface blade pattern which comprises curved refining surface portions. Said curved first refining surface portions 7, i.e. the first blade bars 9, and the second refining surface portions 8, i.e. the first blade grooves 10 can hence run from the direction of the inner circumference 3 of the blade segment 1 to the direction of the outer circumference 4 essentially as intact uniform portions without any points of discontinuity that might cause disturbance both in the actual refining and in the flow of the material that is to be refined and that has been refined. Another advantage is that the microgrooving constituted by the second blade bars 11 and the second blade grooves 12 on the refining surface 2 is directed to the pumping direction, in other words to the same direction as the curvature of the first side edge 5 on the side of the inner circumference 3 of the blade segment 1. When going to the outer circumference 4, the first side edge 5 curves away from the direction of the second blade grooves 12, i.e. to the holding direction.

FIG. 2 schematically shows a second blade segment 1 of a disc refiner seen in the direction of the refining surface 2 of the blade segment 1. The blade segment 1 comprises an inner circumference 3 and an outer circumference 4 of the blade segment 1 and a curved first side edge 5 and a curved second side edge 6 combining the inner circumference 3 and the outer circumference 4. The refining surface 2 of the blade segment 1 comprises first refining surface portions 7 and between them second refining surface portions 8, with the first refining surface portions 7 constituting refining surface portions that refine the material to be refined and with the second refining surface portions 8 constituting refining surface portions that run between the first refining surface portions and that carry the material to be refined. The center lines of the refining surface portions 7, 8 are curved from the direction of the inner circumference 3 of the blade segment 1 to the direction of the outer circumference 4 of the blade segment 1 as shown in FIG. 1.

In FIG. 2, the first refining surface portion 7 comprises a first blade bar 9 and second blade bars 11 constituted at its upper surface and between them second blade grooves 12, with the second refining surface portions 8 being constituted by the first blade grooves 10 between the first blade bars 9, and the first blade grooves 10 constitute the feed grooves 10 of the blade segment 1, which feed grooves 10 carry the material to be refined from the direction of the inner circumference 3 of the blade segment 1 to the direction of the outer circumference 4. The width of the second blade bars 11 can be for example approximately 3.5 to 4.0 millimeters and the width of the second blade grooves 12 can be for example approximately 4.0 to 4.5 millimeters. The depth of the second blade grooves 12 can be for example approximately 5.0 to 11.0 millimeters. The second blade bars 11 and the second blade grooves 12 can be straight or curved in their respective run direction, as shown in FIG. 2. The width and height of the second blade bars 11 and correspondingly the width and depth of the second blade grooves 12 can be constant or they can vary in the run direction of said blade bars 11 and blade grooves 12 within the above-mentioned range of variation.

FIG. 3 schematically shows a third blade segment 1 of a disc refiner seen in the direction of the refining surface 2 of the blade segment 1. The blade segment 1 comprises an inner circumference 3 and an outer circumference 4 of the blade segment 1 and a curved first side edge 5 and a curved second side edge 6 combining the inner circumference 3 and the outer circumference 4. The refining surface 2 of the blade segment 1 comprises first refining surface portions 7 and between them second refining surface portions 8, with the first refining surface portions 7 constituting refining surface portions that refine the material to be refined and with the second refining surface portions 8 constituting refining surface portions that run between the first refining surface portions and that carry the material to be refined. The center lines of the refining surface portions 7, 8 are curved from the direction of the inner circumference 3 of the blade segment 1 to the direction of the outer circumference 4 of the blade segment 1 as shown in FIG. 1.

In FIG. 3, the first refining surface portion 7 comprises a first blade bar 9 and second blade bars 11 constituted at its upper surface and between them second blade grooves 12, with the second refining surface portions 8 being constituted by the first blade grooves 10 between the first blade bars 9, and the first blade grooves 10 constitute the feed grooves 10 of the blade segment 1, which feed grooves 10 carry the material to be refined from the direction of the inner circumference 3 of the blade segment 1 to the direction of the outer circumference 4. On the side of the inner circumference 3 of the blade segment 1 or in its vicinity, the microblading constituted by the second blade bars 11 and the second blade grooves 12 has been arranged to be sparser than on the side of the outer circumference 4 of the blade segment 1 or in its vicinity. On the side of the inner circumference 3 of the blade segment 1, the width of the second blade bars 11 can be for example approximately 2.3 millimeters, and the width of the second blade grooves 12 can be for example approximately 7.0 to 9.0 millimeters, and the depth of the second blade grooves 12 can be for example approximately 8.0 to 18.0 millimeters. On the side of the outer circumference 4 of the blade segment 1, the width of the second blade bars 11 can be for example approximately 2.2 millimeters, and the width of the second blade grooves 12 can be for example approximately 2.8 to 3.6 millimeters, and the depth of the blade grooves 10 can be for example approximately 4.0 to 8.0 millimeters. The blade bars 11 and the blade grooves 12 can be straight or curved in their respective run direction, and the width and depth of the blade grooves 12 can be constant or they can vary in the run direction of said blade grooves 12 for example within the above-mentioned range of variation.

In the blade segments shown in FIGS. 1, 2 and 3, an area free from blade bars 9, 11 has been arranged beside the first side edge 5, whereby said area is intended to constitute at least a portion of the portion of the refining surface 2 of the blade segment 1 intended as a feed groove 10. The portion arranged beside the first side edge 5 of the blade segment 1 free from blade bars 9, 11 is preferably dimensioned so that said portion can constitute a whole feed groove 10, whereby when placing the first side edge 5 of the blade segment 1 with a butt joint with the second side edge 6 of the blade segment 1 located adjacent to it, the formation of an interface between adjacent blade segments is avoided in the area of the feed groove 10, since this might disturb the flow of the material to be refined in the feed groove 10.

For a person having ordinary skill in the art, it is obvious that as technology makes further progress, the basic idea of the invention can be implemented in many different ways. The invention and its embodiments are therefore not restricted to the examples described above, but they may vary within the appended claims.

We claim:

1. A blade segment of a disc refiner intended for refining fibrous material, the blade segment comprising:

an inner circumference and an outer circumference as well as a first side edge and a second side edge which connect the inner circumference and the outer circumference;

wherein the first side edge and the second side edge of the blade segment are curved so that one side edge is concave and the other side edge is convex;

a refining surface of the blade segment, bounded by the inner circumference, the outer circumference, the first side edge, and the second side edge;

wherein the refining surface has first blade bars and first grooves which define a pumping direction;

wherein the first bars and first grooves of the blade segment curve in the vicinity of the inner circumference in the pumping direction, and in the vicinity of the outer circumference in a non-pumping direction.

2. The blade segment of claim 1 wherein the first side edge and the second side edge of the blade segment are curved side edges which have a single first radius of curvature.

3. The blade segment of claim 1 wherein the first blade bars have first refining surface portions that refine the fibrous material and first grooves that run between the first blade bars to carry fibrous material, and define a center line of the first grooves that are curved with a second radius.

4. The blade segment of claim 3 wherein the first radius of curvature and the second radius of curvature are essentially the same.

5. The blade segment of claim 3 wherein first blade bars running in a direction from the inner circumference of the blade segment to the outer circumference and the first blade grooves running in the direction from the inner circumference of the blade segment to the outer circumference of the blade segment and wherein the upper surface of the first blade bars comprises second blade bars and between them second blade grooves.

6. The blade segment of claim 5 wherein the first side edge is concave and wherein the second blade bars and the second blade grooves are directed in a direction which is the same direction as a curvature formed by the convex edge, on a side of the convex edge adjacent to the inner circumference of the blade segment.

7. The blade segment of claim 5 wherein at least one of the first side edge and the second side edge of the blade segment define an area arranged beside at least one of the first side edge and the second side edge of the blade segment, said area being free from second blade bars and second blade grooves to form at least a portion of one of the blade grooves that is formed between two of the blade segments when placed adjacently.

8. The blade segment of claim 5 wherein a cross sectional area defined by at least one of the second blade grooves changes in a run direction of the at least one second blade groove.

9. The blade segment of claim 8 wherein a depth defined by the at least one of the second blade grooves changes in the run direction of the at least one of the second blade grooves.

10. The blade segment of claim 5 wherein a cross sectional area or a depth of at least one of the first blade grooves changes in the run direction of at least one of the first blade groove blades.

11. The blade segment of claim 1 wherein in an area adjacent the outer circumference of the blade segment the non-pumping curve is 0% to 50% of a radius of the blade segment, the radius defined as perpendicular to the inner circumference and the outer circumference.

12. The blade segment of claim 11 wherein in the area adjacent the outer circumference of the blade segment the non-pumping curve is 20% to 40% of a radius of the blade segment.

13. The blade segment of claim 12 wherein in the area adjacent the outer circumference of the blade segment the non-pumping curve is about 30% of a radius of the blade segment.

14. The blade segment of claim 1 wherein the blade segment is a blade segment of a rotatable refining element.

* * * * *